US005775967A

United States Patent [19]

Lacoursiere et al.

[11] Patent Number: 5,775,967

[45] Date of Patent: Jul. 7, 1998

[54] DIAPER SWIM SUIT

[76] Inventors: Regent Lacoursiere; Mary Lacoursiere, both of 7015 Jarry St. East, Montreal, Que., Canada, H1J 1G3

[21] Appl. No.: 621,457

[22] Filed: Mar. 25, 1996

[51] Int. Cl.[6] ..... B63C 9/08

[52] U.S. Cl. ..... 441/115; 441/117; 441/120; 441/124

[58] Field of Search ..... 441/80, 88, 106–119, 441/120, 124

[56] References Cited

U.S. PATENT DOCUMENTS

| | | | |
|---|---|---|---|
| 3,425,072 | 2/1969 | Carlson | 441/114 |
| 4,038,713 | 8/1977 | O'Link | 441/112 |
| 4,047,255 | 9/1977 | Kiefer | 441/106 |
| 4,308,629 | 1/1982 | Freemon | 441/111 |
| 4,871,338 | 10/1989 | Hoffman | 441/115 |
| 4,986,786 | 1/1991 | Helt et al. | 441/120 |
| 5,030,153 | 7/1991 | Bailey | 441/108 |
| 5,152,706 | 10/1992 | Fister | 441/106 |

*Primary Examiner*—Stephen Avila
*Attorney, Agent, or Firm*—Eric Fincham

[57] ABSTRACT

A personal floatation device particularly adapted for home use with babies under parental supervision. The personal floatation device has floatation foam pads sewn into a sturdy, non-slip, woven cotton cover. The back section has three floatation foam panels—the head support, the back support and the pant back. The front section has three floatation foam panels—the pant front, and two elongated suspender panels which are sewn into the waist of the pant and placed vertically over the baby's chest to attach to the lower portion of the floatation foam head support through use of Velcro strips sewn on to each side of the head support. The front and back panels of the pant are secured together with Velcro strips. The floatation foam in the head support has a cut-out hole in which the baby rests his head. The baby's face and breathing passages are clear of the water, allowing the baby to float comfortably in the back float survival position giving complete freedom of movement of arms and legs. A pull strap sewn into the center at the top of the head support is used to pull the baby around on top of the water.

15 Claims, 5 Drawing Sheets

DIAPER SWIM SUIT

FIELD OF THE INVENTION

This invention relates to personal floatation devices.

DIAPER SWIM SUIT BACKGROUND OF THE INVENTION

The inventor of the Diaper Swim Vest is a world champion long distance swimmer and owner of a private swim school in Montreal, Canada, where he has been teaching swimming to babies since 1958. The inventor has given over 1,000,000 swimming lessons to date. The inventor has authored three books on swimming and he is an honoree member in the International Swimming Hall of Fame in Fort Lauderdale, Fla. The inventor has always used floatation devices when teaching beginners to swim regardless of the pupils' age. The floatation devices used will vary to accommodate the age of the person who is learning how to swim. As the inventor started teaching swimming to younger children and to babies, the floatation device had to be designed to meet the needs and to adapt to the development of the new born infant. The only position wherein a baby can survive in the water, is to teach the baby the back float position with the face and breathing passages supported out of the water at all times. The head of the new born baby is heavier then the rest of his body. On average, babies are not physically able to fully support their head before the age of three months. An important feature of the diaper swim vest is the floatation head support containing thicker floatation foam which is needed to keep the head out of the water. To meet the need of new born babies and the demand by parents for teaching techniques for the new born, the invention now gives parents the chance to continue the baby's adaptation to water outside the womb, in the comfort of the home and the warmth of the family bath tub. In the nine months from conception to birth, the unborn child grows inside the mother, surrounded and protected by warm body fluids. Home use of the invention gives the baby the necessary floatation to continue the sensational feeling of weightlessness and floating which the baby experienced inside the mother's womb.

There are many type II floatation vests on the market designed to help save the life of a young child. These floatation vests are required used when boating and parents will place them on their toddlers when near and close to water. These type II floatation vests are designed to save a life by keeping the child in an almost upright position with the head held completely out of the water. Because the purpose of the type II vests as personal floatation devices is to save lives, they are made with very thick floatation foam making them bulky and uncomfortable to wear by young children. The type II vests are designed with zippers, tabs, clips, ties, and a crotch strap. The young child is wrapped tightly by the type II floatation vest, as it must stay in place in time of accident by not being able to ride-up and by use of a crotch strap to keep the child from sliding out of the type II vest. The type II vest sizing charts indicate the smallest size to be for children weighing twenty to thirty (20–30) pounds. This smallest size is too big for use on babies under one year old. None of the type II floatation vests already invented can be conveniently used for home tub bathing with newborn babies and they cannot be used to teach survival back float swimming.

SUMMARY OF THE INVENTION

This new invention is one of a safe floatation swim vest which comprises a back section and front section which folds at the crotch to envelope the baby. The back section has three floatation foam support panels and the front section has three floatation foam support panels. The diaper swim vest is a pliable unit with all floatation foam pads strategically sewn into a non-slip, sturdy cotton sheeting cover. Small hollow spaces separate the floatation foam pads allowing for individual movement of each floatation foam pads, so necessary as movement of the floatation foam pads will help the baby learn how to 'feel his way' through the water as he adapts to floating, learns the survival back float and on to learning how to swim. Two thicknesses of floatation foam are used. Thicker floatation foam is used for the head support panel, necessary to properly support the baby's head out of the water and to support any backward thrust of the head. Thicker foam is also used in the two elongated suspender panels on the front of the diaper swim vest, necessary to keep the baby's body position high on top of the water. These two elongated suspender panels are particularly important for floatation as the baby grows and gains weight. A round, cut-out hole is centered in the lower part of the head support panel. The baby rests his head in the opening on the head support panel. Two Velcro strips are sewn on each side of the head support panel. The front pant panel has Velcro strips sewn on to the inside of the pant. The back pant panel has Velcro strips sewn on to the outside of the pant. The front pant panel overlaps and the Velcro strips fasten to form a diaper pant with two wide leg openings. The crotch keeps the diaper swim vest from riding up. The crotch is wide so as not to cut into the body. Sewn into the front of the pant at the waist are two elongated, rectangular, suspender type floatation panels which have a flat tab sewn into the top seam. Velcro strips are sewn on to each flat tab. These two elongated suspender panels are sewn into the front pant panel at the waist at an angle so that when they are placed on the baby's body, they separate away from the face. The two Velcro strips sewn on to the end of each tab on each elongated suspender panel are joined to each Velcro strip sewn on each side of the head support panel. A floatation foam pad is sewn into the back support and a floatation foam pad is sewn into the back pant panel. A floatation foam pad is sewn into the center of the front pant panel. All floatation foam pads are buoyant floatation material, either cut or molded to shape from closed cell foam which may be cut from polyvinyl chloride or polyethylene foam.

All floatation foam pads of the back section and all floatation foam pads of the front section are sewn into two layers of cotton fabric disposed in overlying, registering relationship and having a peripheral edge seam defined by stitching about the periphery thereof.

A pull strap handle is sewn into the top of the head support, which parents use to pull the baby across the surface of the water, while teaching the baby to learn the survival back float and encourage exercising through kicking leg movements and splashing arm movements.

OBJECTS OF THE INVENTION

Prenatal and postnatal aquatic exercises are contributing to healthy pregnancies. New born babies are introduced to daily exercise periods early in life. The diaper swim vest gives the baby the necessary buoyancy needed to learn the survival back float while freely kicking his legs and moving his arms, benefiting from the positive effects of warm water massage therapy in the comfort of the family tub. The baby learns breath control by keeping his head in position with the face out of the water. The baby quickly learns the survival back float. The baby can be washed while floating in the diaper swim vest as the design is such that the parent has access to all parts of the baby's body. Daily use of the diaper swim vest encourages physical development and is a relaxation, quality time activity shared between parent and baby. Use of the invention before bed time helps a baby sleep better.

In accordance with this general object, this invention will now be described on reference to the accompanying drawings in which:

DETAILED DESCRIPTION OF THE PREFERRED EMBODIMENT

Figure 1:
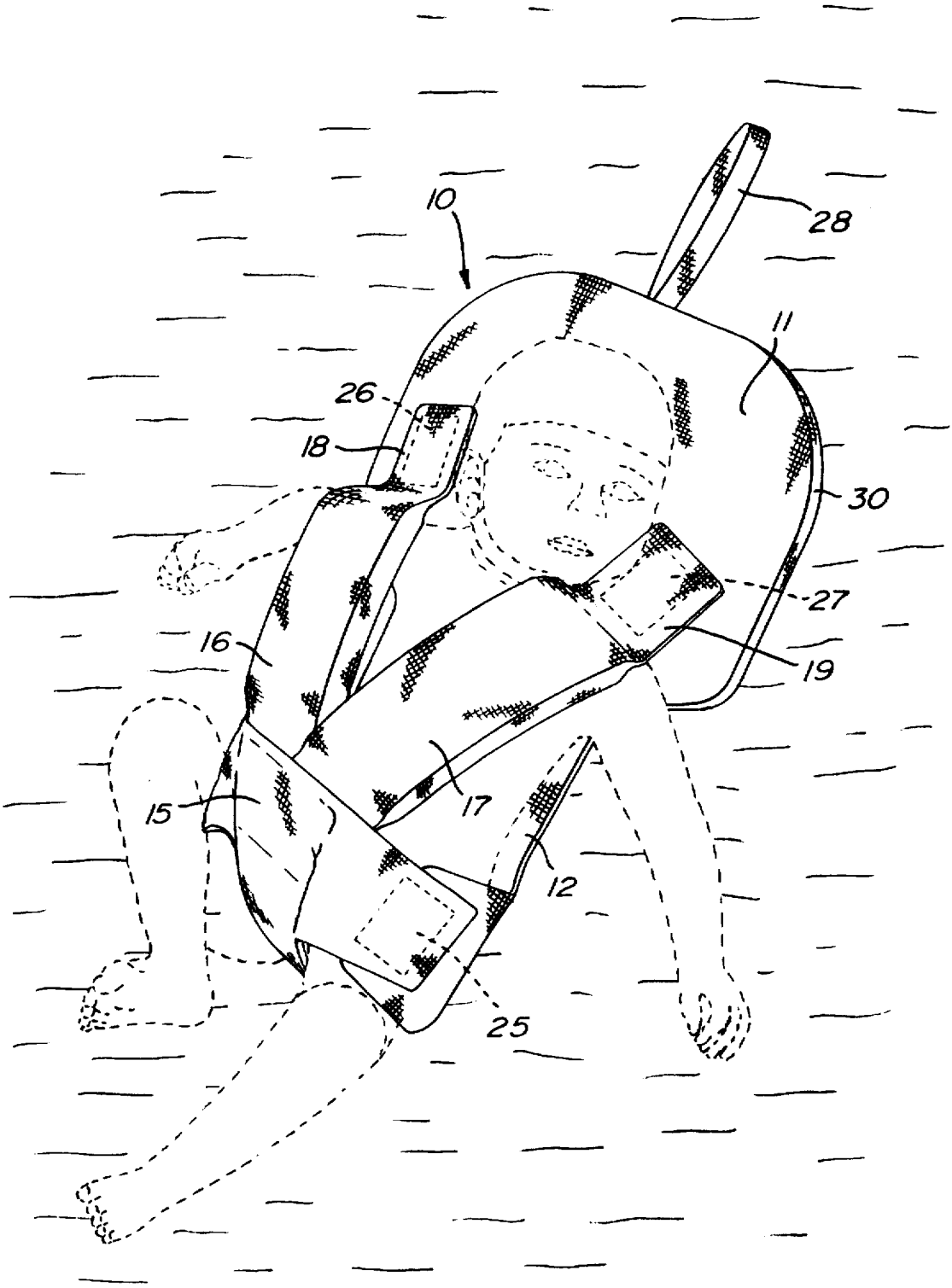
FIG. 1 is a front perspective view of the personal floatation device showing the position of the baby in the water as he floats on his back, enveloped in the diaper swim vest with his head supported out of the water.
Figure 2:
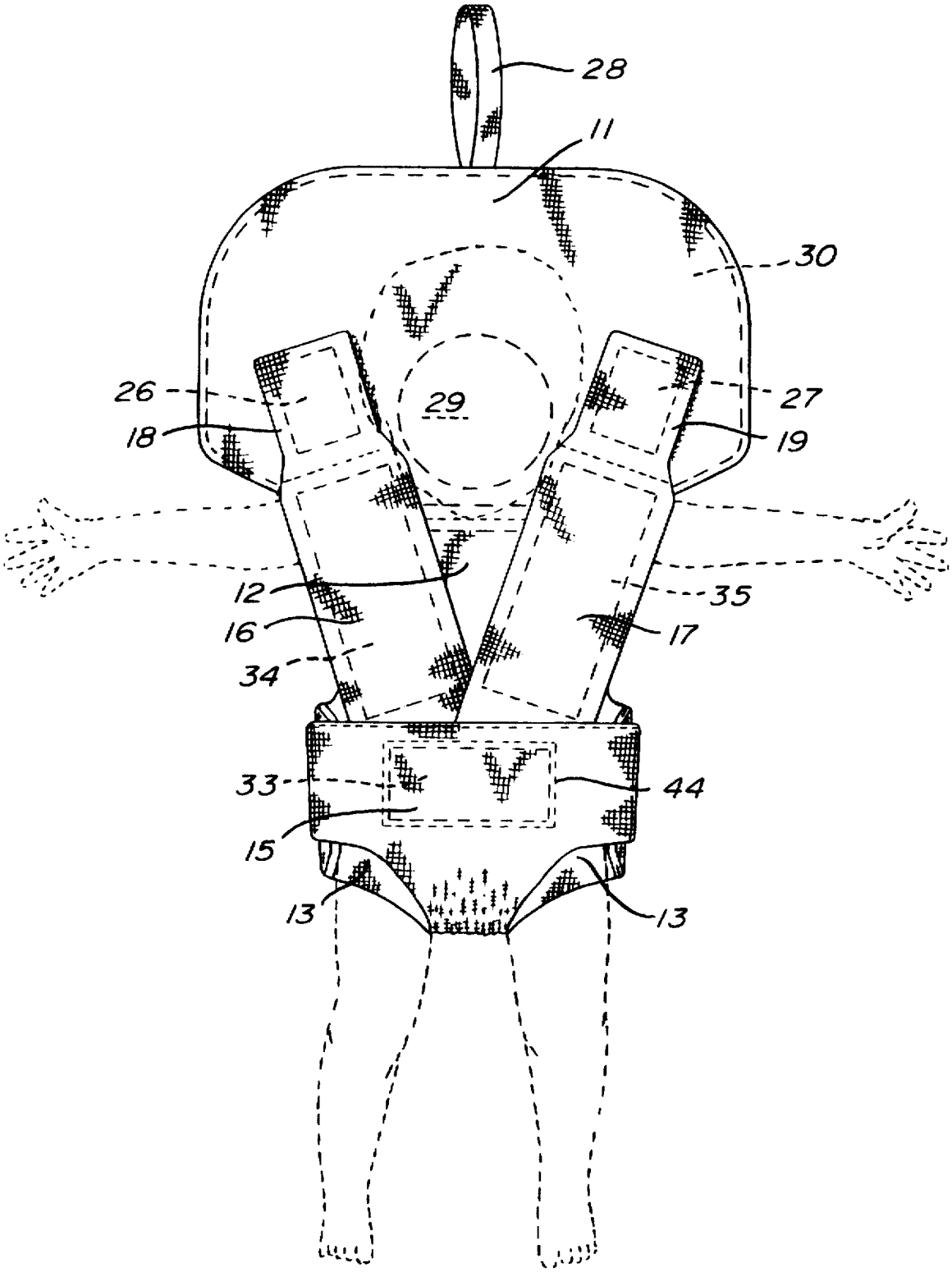
FIG. 2 is a perspective view of the personal floatation device showing the position of the baby before the baby is placed in the water.
Figure 3:
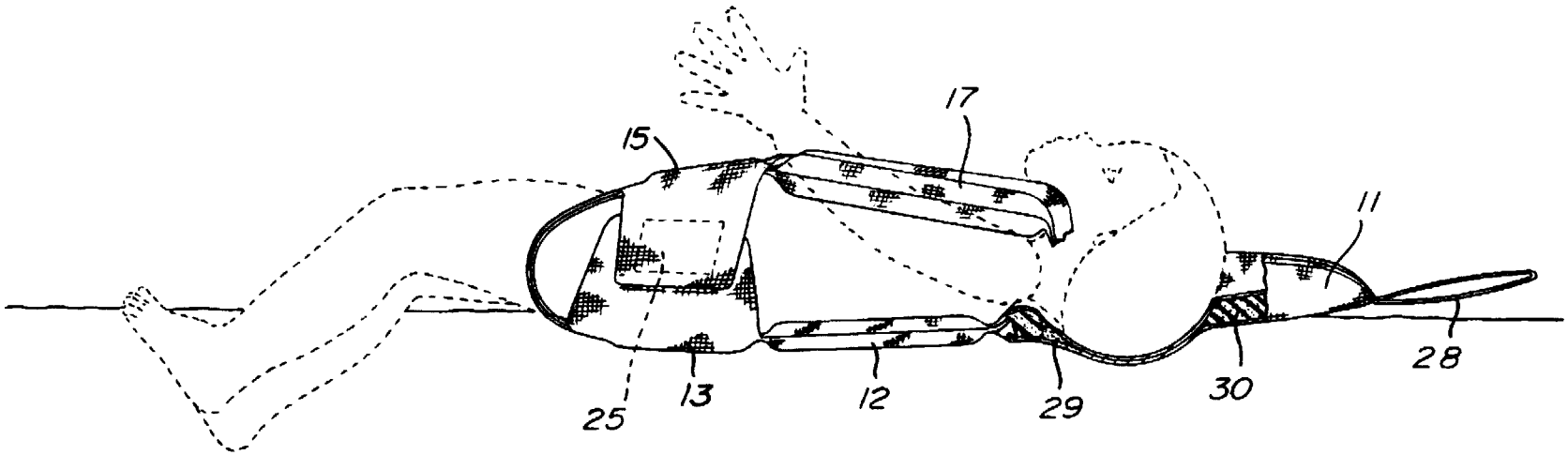
FIG. 3 is an elevated side view of the personal floatation device showing the position of the baby as he floats of top of the water, also showing the wide arm hole opening which extends from the waist to the neck.
Figure 4:
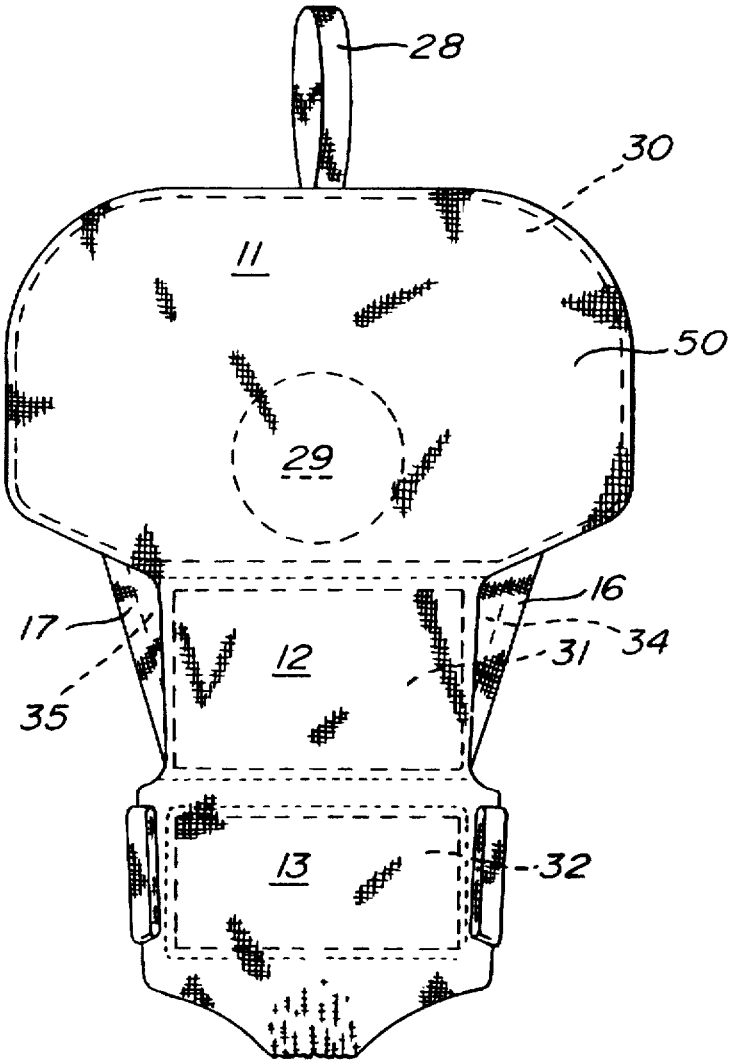
FIG. 4 is an elevated rear view of the personal floatation device.
Figure 5:
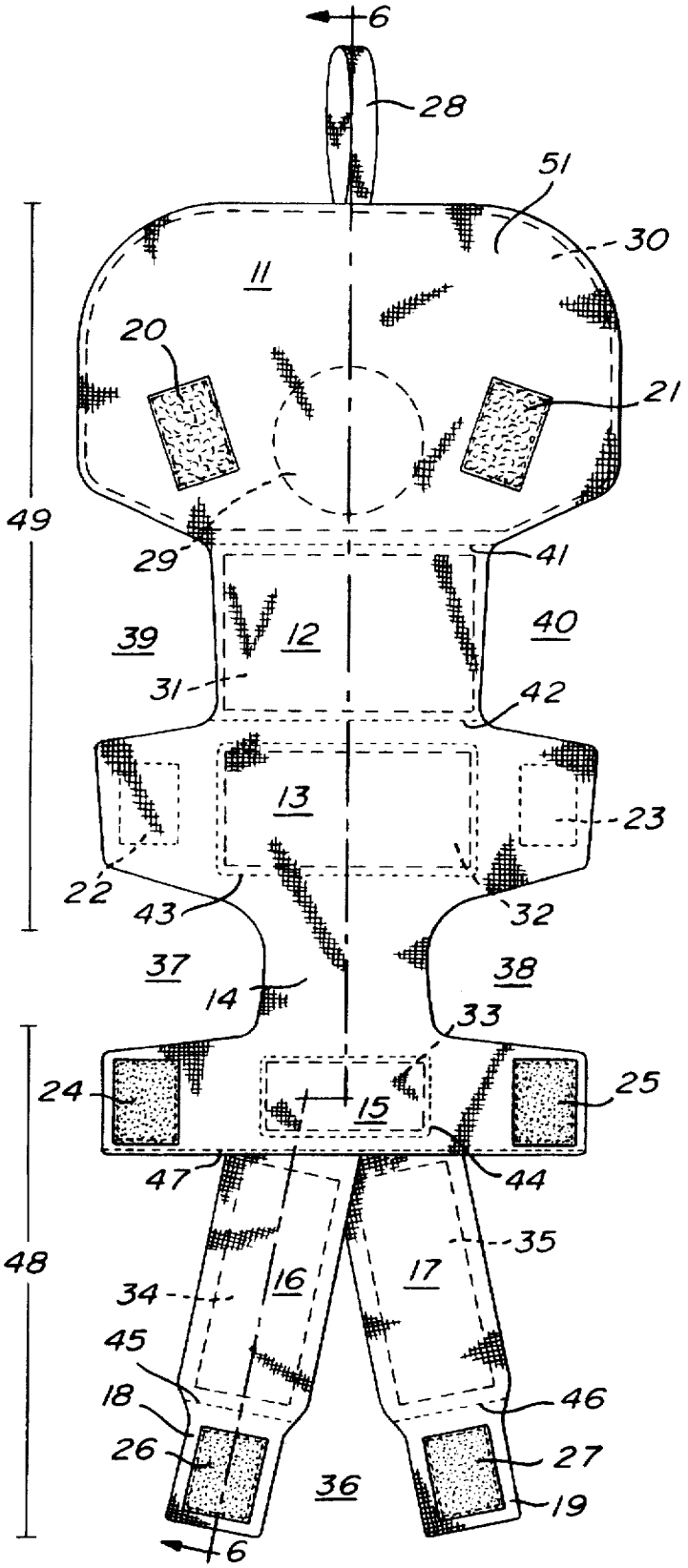
FIG. 5 is a view of the personal floatation device showing the invention as a one piece unit.
Figure 6:
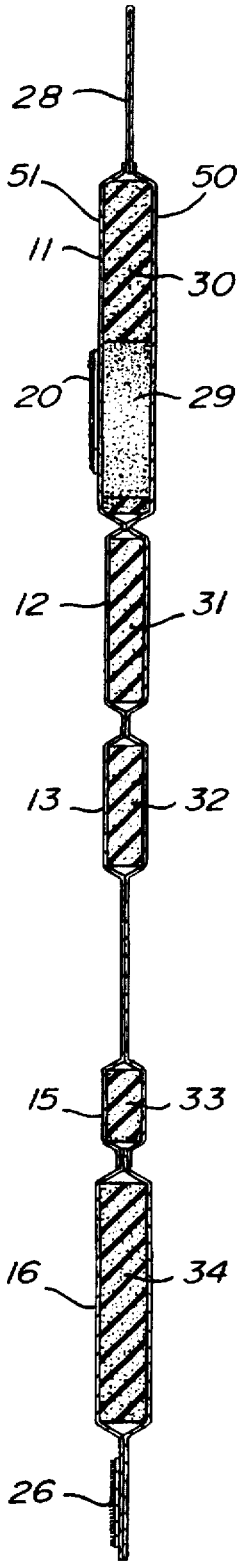
FIG. 6 is a view of the varying thickness of floatation foam used in the different areas of the invention.

Referring to FIGS. 1 to 6, this personal floatation device is generally designated by reference to number 10, FIG. 1. The personal floatation device 10 is a one piece unit which folds at the crotch 14. The front section 48 of the personal floatation device 10 is made of three pliable panels which contain floatation foam—the front pant panel 15, the left elongated suspender panel 16 and the right elongated suspender panel 17. Sewn into the top of the left elongated suspender panel 16 is a flat tab 18 onto which is sewn a Velcro strip 26. Sewn into the top of the right elongated suspender panel 17 is a flat tab 19 onto which is sewn a Velcro strip 27. The left elongated suspender panel 16 is a mirror image of the right elongated suspender panel 17. The Velcro strip 26 on the left elongated suspender panel 16 is attached to the Velcro strip 20 located on the left side of the head support panel 11. The Velcro strip 27 on the right elongated suspender panel 17 is attached to the Velcro strip 21 located on the right side of the head support panel 11. The left elongated suspender panel 16 and the right elongated suspender panel 17 are sewn into the front waist seam 47. The two elongated suspender panels 16 and 17 are overlapped at the center seam and sewn into the waist seam 47 at an angle so that the left elongated suspender panel 16 and the right elongated suspender panel 17 separate when attached to the Velcro strip 20 and 21 on the head support panel 11, leaving a wide unrestrained opening for the baby's head. A Velcro strip 24 is sewn inside on the left side of the front pant panel 15 and a Velcro strip 25 is sewn inside on the right side of the front pant panel 15.

The back section 49 of the personal floatation device 10 is made of three pliable panels which contain floatation foam. The largest section of the back 49 is the head support panel 11. The head support panel 11 is a horizontal, rectangular shape with rounded corners. The head support 11 has a round cut-out hole opening 29, which is centered in the lower part of the head support panel 11. The back is supported by a rectangular back panel 12 and the seat is supported by a rectangular panel in the back pant panel 13. A Velcro strip 22 is sewn outside on the left side of the pant back panel 13 and a Velcro strip 23 is sewn outside on the right side of the pant back panel 13.

DETAILED DESCRIPTION OF THE PREFERRED EMBODIMENT

The personal floatation device 10 folds at the crotch 14. The two Velcro strips sewn on the inside of the front pant panel 15, left side 24 and right side 25 overlap the back pant panel 13 to join and fasten with the left side Velcro strip 22 and the right side Velcro strip 23. A wide left leg opening 37 and a wide right leg opening 38 is formed when the front pant panel 15 is attached to the back pant panel 13. The left side 39 and the right side 40 of the personal floatation device 10 is open (FIG. 3) from the waist to the neck, allowing the baby free movement of the arms and shoulders. The baby's head is placed in the cut-out hole 29 located in the lower center part of the head support panel 11. The baby's head is supported out of the water so that the face and all breathing passages are clear and without hindrance. A pull strap handle 28 is sewn into the center at the top of the head support panel 11. All of the floatation foam pads are cut to fill entirely each of the designated support panels. The floatation foam pad 30 used for the head support panel 11 is three quarter inch (¾") thick floatation foam and is sewn securely in place by a sturdy stitch seam 41 sewn along the bottom of the head support panel 11. The floatation foam pad 31 used for the back support panel 12 is half inch (½") thick floatation foam and is sewn securely in place by a sturdy stitch seam 42 along the bottom of the back support panel 12. Half inch (½") thick floatation foam 32 is used for the back seat panel 13 and is securely in place by a sturdy stitch seam 43 sewn around the four sides of the floatation foam pad 32. Half inch (½") thick floatation foam 33 is used for the pant front panel 15 and is securely sewn in place by a sturdy stitch seam 44 sewn around the four sides of the floatation foam pad 33. Three quarter (¾") thick floatation foam pads 34 are sewn into each of the two elongated suspender panels, left side 16 and right side 17, securely sewn into place by sturdy stitching, left seam 45 and right seam 46. The left seam 45 and the right seam 46 are reinforced as they hold in place the flat tabs, left 18 and right 19, on to which are sewn the two Velcro strips, left 26 and right 27.

The personal floatation device 10 is sewn together along designated seam lines using sturdy thread and using a minimum seam width of about one half (½") inch. The personal floatation device has an inner web 48 and an outer web 49 of vowem cotton sheeting fabric which are assembled in overlying relationship and sewn around the respective dimensions to define each panel part. Hollow areas are found between the panels which makes the personal floatation device pliable, giving movability to the wearer.

Changes and substitutions may be made to the preferred embodiment. For example, the woven cotton fabric can be replaced by other materials such as nylon, polyester, spandex, canvas. The Velcro attachments can be replaced with buttons, ties, snaps, zippers, clips. The floatation foam pads can be closed cell foam coated or uncoated, polyvinyl chloride, polyethylene and other floatation materials commercially available. All alternate floatation materials must have sufficient buoyancy qualities to supply the necessary floatation required by each floatation panel. Floatation foam pads can be die cut or molded. Instead of sewing and stitching the seams, the seams can be held together through use of ultrasonic welding, adhesive bonding, or heat seal, providing these alternate methods have the required strength to provide the durability and resistance needed to give the product continued and safe use. The front section 48 folds at the crotch 14 and the front pant panel 15 wraps around the lower part of the baby's body forming a pant which holds the baby in place and eliminates ride-up. All Velcro strip tabs 20, 21, 22, 23, 24, 25, 26, 27, are three inches (3") in length which makes the personal floatation device 10 adjustable and usable over a longer period of time, as the width 3f the pant can be widened and the length of the personal floatation device 10 can be lengthened to accommodate a growing baby.

This personal floatation device 10 as illustrated in drawings, FIGS. 1 to 6, is intended for use with babies and only under the supervision of parents or a responsible adult.

This personal floatation device can be made in sizes to fit children and adults and would be used to teach all ages the survival back float. The adjustable fasteners used in the personal floatation device 10 referred to as Velcro are produced by the Velcro Corporation of New York, N.Y. and marketed under the trademark 'VELCRO'.

What we claim is:

1. A flotation device for a child, the device comprising an upper section having flotation means designed to be adjacent to a rear head area of the child, a lower section having flotation means and designed to be adjacent the crotch and lower torso of the child, and an intermediate section having flotation means extending between said upper section and said lower section and designed to be adjacent an upper torso area of the child, said lower section having a diaper like configuration and having means for securing together a front and back portion thereof, and means for securing said front portion of said lower section to said upper section said flotation means of said upper section comprising a flotation panel, a recess being formed in said flotation panel to receive a rear portion of a child's head.

2. The device of claim 1 wherein said upper section comprises an inner and an outer web layer enclosing said flotation panel said inner and outer web layers extending across said recess.

3. The device of claim 1 wherein said flotation panel comprises a closed cell foam flotation panel.

4. The device of claim 1 wherein said intermediate section flotation means comprises a flotation panel enclosed between inner and outer web layers.

5. The device of claim 4 wherein said flotation panel of said intermediate section comprises a closed cell foam flotation panel.

6. The device of claim 1 wherein said flotation means of said lower section comprises at least one flotation panel located in said front portion and at least one flotation panel located in said back portion.

7. The device of claim 2 wherein said lower section comprises an inner and an outer web layer having a plurality of flotation panels contained therebetween, at least one of said flotation panels of said lower section being in said front portion and at least one of said flotation panels being in said back portion.

8. The device of claim 7 wherein said flotation panels of said lower section each comprise a closed cell foam flotation panel.

9. The device of claim 1 wherein said means for securing said front portion of said lower section to said upper section comprises first and second elongated suspender panels, each of said suspender panels having flotation means.

10. The device of claim 9 wherein each of said suspender panels comprises a closed cell foam material.

11. The device of claim 9 wherein each of said suspender panels comprise an inner and an outer web layer having a flotation panel therebetween.

12. The device of claim 2 wherein said means for securing said front portion of said lower section to said upper section comprises first and second suspender panels, each of said suspender panels comprising an inner and an outer web layer having a flotation panel therebetween, each of said suspender panels having a first end attached to said front portion of said lower section, and a second end thereof releasably secured to said upper section.

13. The device of claim 1 wherein said flotation means of said lower section and said flotation means of said intermediate section each comprise at least one flotation panel enclosed between inner and outer web layers to retain said flotation panels, said flotation panel of said upper section having a greater thickness than said flotation panel of said lower section.

14. The device of claim 1 further including a pull strap secured to said upper section.

15. A flotation device for a baby, the device comprising first and second web layers having a plurality of flotation panels secured therebetween, said device comprising an upper section designed to be adjacent the head area of the baby and having one of said flotation panels associated therewith, a lower section adapted to be adjacent the crotch and lower torso of the baby, and an intermediate section extending between said upper section and said lower section adapted to be adjacent the back of the upper torso of the baby, said lower section having a diaper like configuration and having means for securing together a front and back portion thereof, each of said front and back portions having at least one of said flotation panels located thereat, one of said flotation panels being located in said intermediate section, and a pair of suspender panels extending between said front portion of said lower section and said upper section, each of said suspender panels having flotation means associated therewith, said means for securing said suspender panels to said upper section comprising releasable securement means.

* * * * *

UNITED STATES PATENT AND TRADEMARK OFFICE

CERTIFICATE OF CORRECTION

PATENT NO. : 5,775,967

DATED : July 7, 1998

INVENTOR(S) : Regent Lacoursiere

It is certified that error appears in the above-identified patent and that said Letters Patent is hereby corrected as shown below:

Title page, item [76] inventors: Mary Lacoursiere should be deleted.

Signed and Sealed this

Sixteenth Day of February, 1999

*Attest:*

*Attesting Officer*

*Acting Commissioner of Patents and Trademarks*